United States Patent [19]

Watanabe

[11] Patent Number: 5,000,863

[45] Date of Patent: Mar. 19, 1991

[54] LUBRICATION BOOSTING ADDITIVES COMPRISING ORGANIC TITANIUM COMPOUNDS AND LUBRICATING OIL COMPOSITIONS COMPRISING THE SAME

[75] Inventor: Ryoji Watanabe, Osaka, Japan

[73] Assignees: Violet Co., Ltd.; Wako Technical Co., Ltd., Japan

[21] Appl. No.: 379,749

[22] Filed: Jul. 14, 1989

[30] Foreign Application Priority Data

Jul. 20, 1988 [JP] Japan ..... 63-180999

[51] Int. Cl.[5] ..... C10M 139/00

[52] U.S. Cl. ..... 252/42.7; 252/52 R; 252/56 R; 252/56 S

[58] Field of Search ..... 252/42.7

[56] References Cited

U.S. PATENT DOCUMENTS

| | | | |
|---|---|---|---|
| 2,160,273 | 5/1959 | Loane | 252/42.7 |
| 2,891,910 | 6/1959 | Furey | 252/42.7 |
| 3,003,963 | 10/1961 | Kay | 252/42.7 |
| 3,032,570 | 5/1962 | Haslam | 252/42.7 |
| 3,083,168 | 3/1963 | Young | 252/42.7 |
| 3,150,091 | 9/1964 | Young | 252/42.7 |
| 3,398,170 | 8/1968 | Cyba | 260/439 |
| 3,779,920 | 12/1973 | Devries | 252/42.7 |
| 4,790,957 | 12/1988 | Mach | 252/565 |

FOREIGN PATENT DOCUMENTS

| | | | |
|---|---|---|---|
| 641613 | 5/1962 | Canada | 252/42.7 |
| 62-95395 | 1/1987 | Japan . | |
| 8704454 | 7/1987 | PCT Int'l Appl. . | |
| 0866054 | 4/1961 | United Kingdom . | |

*Primary Examiner*—Olik Chaudhuri
*Assistant Examiner*—Ellen McAvoy
*Attorney, Agent, or Firm*—Lowe, Price, LeBlanc, Becker & Shur

[57] ABSTRACT

A lubrication boosting additive comprising a mixture of an organic titanium compound soluble in a solvent, an organic solvent for the organic titanium compound, and a phthalic ester. The additive is used in combination with lubricating oils to improve load bearing capacity and wear resistance. When added to lubricating oil, the additive is used in an amount of from 0.1 to 10 g, calculated as the organic titanium compound, per liter of the lubricating oil.

18 Claims, No Drawings

LUBRICATION BOOSTING ADDITIVES COMPRISING ORGANIC TITANIUM COMPOUNDS AND LUBRICATING OIL COMPOSITIONS COMPRISING THE SAME

BACKGROUND OF THE INVENTION

1. Field of the Invention

This invention relates to additives for improving lubricating characteristics of lubricating oils and more particularly, to lubrication boosting additives which, when added to lubricating oils for use in power engines, can improve load bearing properties of the oils and can prevent wear of the power engines while mitigating the lowering of an energy efficiency owing to the friction.

2. Description of the Prior Art

As is well known in the art, lubrication boosting additives have been widely used in order to improve lubricating characteristics of lubricating oils. Typical examples of the commercially sold additives include suspensions of polytetrafluoroethylene (PTFE) and molybdenum sulfide in the form of fine powder. Polytetrafluoroethylene is a resin which has good lubricating characteristics and a high chemical resistance, but is inconveniently insoluble in almost all the types of solvents, thus making it impossible to use the PTFE resin as a solution. This is why the PTFE resin is used as a fine powder suspended in a medium. However, the use of the suspension presents a serious problem with respect to its compatibility with or dispersability in lubricating oil. For instance, the fine powder may settle in the suspension prior to use or after mixing with lubricating oil. Alternatively, the fine powder may deposit in power engines or may clog filters used in association with the engines.

Moreover, the fine powder of PTFE or molybdenum disulfide rarely contributes to the improvement of the load bearing properties when added to lubricating oils.

We have already proposed in U.S. Pat. No. 4,826,614 a oil boosting additive which comprises a fluororesin and a phthalic ester dissolved in an organic solvent. This is very effective for use as an additive to lubricating oils which are employed in power engines. In this additive, the fluororesin is used in large amounts and is relatively expensive.

SUMMARY OF THE INVENTION

It is an object of the invention to provide a lubrication boosting additive which is used as a solution for addition to lubricating oils and which can impart improved load bearing properties and an improved wear resistance to lubricating oils.

It is another object of the invention to provide a lubrication boosting additive which can increase a power output and can suppress noises of engine systems, such as internal combustion engines when applied to lubricating oils for use in the engine systems.

It is a further object of the invention to provide a lubrication boosting additive which can reduce a fuel cost and can prolong the life of parts on application to lubricating oils for use in internal combustion engines of motor vehicles.

It is a still further object of the invention to provide a lubrication boosting additive which comprises an organic titanium compound which is effective for lubrication boosting when used in small amounts in combination with phthalic esters.

It is another object of the invention to provide a lubricating oil composition which comprises the lubrication boosting additive mentioned above.

The above objects can be achieved, according to the invention, by a lubrication boosting additive which comprises 1 part by weight of an organic titanium compound soluble in an organic solvent, from 6 to 60 parts by weight of an organic solvent from the organic titanium compound, and from 10 to 1000 parts by weight of a phthalic ester. It is considered that the organic titanium compound improves the load bearing characteristics when added to lubricating oils and that the phthalic ester improves the wear resistance.

When added to lubricating oil, the lubrication boosting additive is used in an amount of from 0.01 to 10 g, calculated as the organic titanium compound, per liter of the lubricating oil.

DETAILED DESCRIPTION AND EMBODIMENTS OF THE INVENTION

The organic titanium compound which is one of the ingredients in the lubrication boosting additive of the invention should be soluble in organic solvent. In general, organic titanium compounds have been developed and used as a water repellent, a surface treating agent and a surface film-forming ingredient for a specific type of lamp. The organic titanium compounds useful in the present invention may be any known organic titanium compound which is soluble in ordinary organic solvents, including those used for the treatment of a specific type of lamp. Specific and preferable examples of the organic titanium compounds include tetraalkoxy titanium compounds such as tetraisopropoxy titanium, tetra-n-butoxy titanium and the like, titanium acylate compounds such as alkoxy-polytitanium acylate and the like, and titanium chelate compounds such as titanium acetylacetonate and the like.

The solvents used to dissolve the organic titanium compound include non-aqueous alcohols, esters and the like. Preferable examples of the solvent include methyl alcohol, ethyl alcohol, isopropyl alcohol, isobutyl alcohol, ethyl acetate, butyl acetate, ethoxyethyl acetate and the like. These solvent may be used singly or in combination. Of these, ethyl alcohol and/or ethyl acetate is preferred.

The phthalic acid esters improve a wear resistance which may be slightly lowered by the addition of the soluble organic titanium compound. Examples of the phthalic esters include dibutyl phthalate, dioctyl phthalate, diisodecyl phthalate and the like. Of these, dibutyl phthalate and dioctyl phthalate are preferred.

The amounts of the respective ingredients may depend upon the types of lubricating oil, organic titanium compound, solvent and phthalic ester. In general, the solvent is used in an amount of from 6 to 60 parts by weight (hereinafter referred to simply as parts), preferably from 10 to 30 parts and the phthalic ester is used in an amount of from 10 to 1000 parts, preferably from 50 to 500 parts, each based on unit part of the organic titanium compound.

The lubrication boosting additive of the invention is used in the form of a solution but may contain a small amount of insoluble matters. When the amount of the phthalic ester increases, compatibility with soluble organic titanium compound and a lubricating oil may lower to a slight extent. Such an increase will tend to more improve the load bearing properties of lubricating oils owing to the soluble organic titanium compound.

Preferable lubrication boosting additives of the invention should comprise 1 part of a soluble organic titanium compound, from 3 to 80 parts, preferably from 5 to 20 parts, of ethyl alcohol and from 3 to 30 parts, preferably from 5 to 20 parts, of ethyl acetate, and from 10 to 1000 parts, preferably from 50 to 500 parts, of dioctyl phthalate.

The soluble organic titanium compound may be formulated as it is or after dissolution in solvent.

The lubricating oils adapted for use with the lubrication boosting additive of the invention may be any lubricating oil which is ordinarily used in engine systems such as reciprocating engines, turbo-propeller engines, rotary engines and the like and also in movable parts such as bearings. The lubrication boosting additive is added to lubricating oils in amounts of from 0.01 to 10 g, preferably from 0.1 to 4 g, per liter of lubricating oil.

In practical applications, it is preferred that the additive of the invention is pre-mixed with a small amount of a lubricating oil. This permits the additive to be more readily mixed with or dispersed in a lubricating oil. For the pre-mixing, a lubricating oil is preferably added to the boosting additive in an amount of from 1 to 300 parts per 10 parts of the soluble organic titanium compound.

The present invention is more particularly described by way of example, which should not be construed as limiting the invention.

EXAMPLE

A soluble organic titanium compound used was a solution of an organic titanium compound for lamp coating (available from Ushio Inc.). to which ethyl alcohol, ethyl acetate and dioctyl phthalate were, respectively, added in amounts indicated in the following table, thereby obtaining lubrication boosting additives. These additives were each added to one liter of a lubricating oil (engine oil for automobiles, available from Idemitsu Kosan Co., Ltd.) in amounts, calculated as the organic titanium compound, indicated in the table. The resulting lubricating oil compositions were subjected to measurements of a load bearing property and a wear resistance. These properties were determined by the Soda four ball friction tester and expressed in terms of a load bearing capacity and a diameter of wear defect. The results are shown in the table below.

TABLE

| Test No. | Additive Composition (parts by weight) | | | | Amount of Organic titanium in one liter of Lubricating Oil (g) | Lubricating Characteristics | |
|---|---|---|---|---|---|---|---|
| | soluble organic titanium | ethyl alcohol | ethyl acetate | DOP | | load bearing capacity (MPa) | wear resistance (mm) |
| 1 | — | — | — | — | — | 0.25 | 0.59 |
| 2 | 1 | 20 | 10 | 400 | 0.2 | 0.40 | 0.56 |
| 3 | 1 | 10 | 20 | 200 | 0.2 | 0.35 | 0.56 |
| 4 | 1 | 10 | 20 | 100 | 0.4 | 0.35 | 0.57 |
| 5 | 1 | 20 | 10 | — | 0.2 | 0.30 | 0.62 |
| 6 | 1 | 40 | 40 | — | 0.4 | 0.30 | 0.63 |
| 7 | 1 | 20 | 10 | — | 0.01 | 0.25 | 0.60 |

As will be apparent from the above results, when DOP is not used (Test Nos. 5 to 7), the load bearing capacity is improved but the wear resistance lowers. However, when DOP is added (Test Nos. 2 to 4), the load bearing capacity is improved with a good wear resistance. When the organic titanium compound is added, the load bearing capacity of the lubricating oil is significantly improved. This becomes remarkable when the organic titanium compound is used in combination with DOP.

It will be noted that all the additives of the invention were found not to cause phase separation or gelation 3 days after the preparation and could be readily and uniformly mixed with the lubricating oil.

What is claimed is:

1. A lubrication boosting additive for lubrication boosting of lubricating oils which comprises 1 part by weight of an organic titanium compound, from 6 to 60 parts by weight of a solvent for said organic titanium compound, and from 10 to 1000 parts by weight of a phthalic ester, whereby load bearing characteristics and wear resistance are improved when said additive is added to lubricating oils.

2. A lubrication boosting additive according to claim 1, wherein said organic titanium compound is selected from the group consisting of tetraalkoxy titanium compounds, titanium acylate compounds, titanium chelate compounds and mixtures thereof.

3. A lubrication boosting additive according to claim 2, wherein said organic titanium compound is a tetraalkoxy titanium compound.

4. A lubrication boosting additive according to claim 1, wherein said solvent is a member selected from the group consisting of ethyl alcohol, ethyl acetate and mixtures thereof.

5. A lubrication boosting additive according to claim 1, wherein said solvent is used in an amount of from 10 to 30 parts by weight.

6. A lubrication boosting additive according to claim 1, wherein said phthalic ester is selected from the group consisting of dioctyl phthalate, dibutyl phthalate and mixtures thereof.

7. A lubrication boosting additive according to claim 1, wherein said phthalic ester is used in an amount of from 50 to 500 parts by weight.

8. A lubrication boosting additive which comprises 1 part by weight of an organic titanium compound, a mixed solvent of from 3 to 30 parts by weight of ethyl alcohol and from 3 to 30 parts by weight of ethyl acetate used as a solvent for the organic titanium compound, and from 10 to 100 parts by weight of dioctyl phthalate.

9. A lubricating oil composition which comprises a lubricating oil and a lubrication boosting additive comprising 1 part by weight of an organic titanium compound, from 6 to 60 parts by weight of a solvent for said organic titanium compound, and from 10 to 1000 parts by weight of a phthalic ester, wherein said lubrication boosting additive is used in an amount of from 0.01 to 10 g, calculated as said organic titanium compound, per liter of said lubricating oil.

10. A lubrication boosting composition according to claim 9, wherein said solvent is a member selected from the group consisting of ethyl alcohol, ethyl acetate and mixtures thereof.

11. A lubrication boosting composition according to claim 9, wherein said phthalic ester is selected from the group consisting of dioctyl phthalate, dibutyl phthalate and mixtures thereof.

12. A lubrication boosting composition according to claim 9, wherein said lubrication boosting additive comprises 1 part by weight of an organic titanium compound, a mixed solvent of from 3 to 30 parts by weight of ethyl alcohol and from 3 to 30 parts by weight of ethyl acetate used as a solvent for the organic titanium compound, and from 10 to 100 parts by weight of dioctyl phthalate.

13. A lubrication boosting composition for incorporation into a lubrication oil which comprises a load bearing improver which comprises an organic titanium compound, a wear resistance improver which comprises a phthalic ester, and solvent for said load bearing and wear resistance improver.

14. A lubrication boosting composition according to claim 13, wherein said load bearing improver comprises 1 part by weight of said composition, said wear resistance improver comprises from 10 to 1000 parts by weight of said composition, and said solvent comprises from 6 to 60 parts by weight of said composition.

15. A lubrication boosting composition according to claim 13, wherein said organic titanium compound is selected from the group consisting of tetraalkoxy titanium compounds, titanium acylate compounds, titanium chelate compounds and mixtures thereof.

16. A lubrication boosting composition according to claim 15, wherein said organic titanium compound is a tetraalkoxy titanium compound.

17. A lubrication boosting composition according to claim 13, wherein said solvent is a member selected from the group consisting of ethyl alcohol, ethyl acetate and mixtures thereof.

18. A lubrication boosting composition according to claim 13, wherein said phthalic ester is selected from the group consisting of dioctyl phthalate, dibutyl phthalate and mixtures thereof.

* * * * *